US006610021B1

(12) United States Patent
Bock

(10) Patent No.: US 6,610,021 B1
(45) Date of Patent: Aug. 26, 2003

(54) INTEGRAL COMPRESSION SLEEVES AND MANIFOLD TUBING SET

(75) Inventor: Malcom G. Bock, Medfield, MA (US)

(73) Assignee: Tyco Healthcare Group LP, Mansfield, MA (US)

( * ) Notice: Subject to any disclaimer, the term of this patent is extended or adjusted under 35 U.S.C. 154(b) by 444 days.

(21) Appl. No.: 08/874,805

(22) Filed: Jun. 13, 1997

Related U.S. Application Data

(63) Continuation of application No. 08/497,002, filed on Jun. 30, 1995, now abandoned, which is a continuation of application No. 08/218,409, filed on Mar. 28, 1994, now abandoned.

(51) Int. Cl.[7] ..... A61H 9/00
(52) U.S. Cl. ..... 601/152
(58) Field of Search ..... 601/149, 151, 601/152

(56) References Cited

U.S. PATENT DOCUMENTS

| | | | | | |
|---|---|---|---|---|---|
| 3,288,132 | A | * | 11/1966 | Meredith | 601/152 |
| 4,013,069 | A | | 3/1977 | Hasty | |
| 4,029,087 | A | | 6/1977 | Dye et al. | |
| 4,030,488 | A | | 6/1977 | Hasty | |
| 4,091,804 | A | | 5/1978 | Hasty | |
| 4,156,425 | A | | 5/1979 | Arkans | |
| 4,198,961 | A | | 4/1980 | Arkans | |
| 4,202,325 | A | | 5/1980 | Villari et al. | |
| 4,207,875 | A | | 6/1980 | Arkans | |
| 4,207,876 | A | | 6/1980 | Annis | |
| 4,253,449 | A | * | 3/1981 | Arkans et al. | 128/24 R |
| 4,280,485 | A | | 7/1981 | Arkans | |
| 4,320,746 | A | | 3/1982 | Arkans et al. | |
| 4,331,133 | A | | 5/1982 | Arkans | |
| 4,372,297 | A | | 2/1983 | Perlin | |
| 4,375,217 | A | | 3/1983 | Arkans | |
| 4,396,010 | A | | 8/1983 | Arkans | |
| 4,402,312 | A | | 9/1983 | Villari et al. | |
| 4,481,937 | A | | 11/1984 | Arkans | |
| 4,574,812 | A | | 3/1986 | Arkans | |
| 4,583,255 | A | * | 4/1986 | Mogaki et al. | 601/150 |
| 4,793,328 | A | | 12/1988 | Kolstedt et al. | |
| 4,804,208 | A | | 2/1989 | Dye | 285/26 |
| 4,827,912 | A | | 5/1989 | Carrington et al. | |
| 4,858,596 | A | | 8/1989 | Kolstedt et al. | |
| 4,922,893 | A | * | 5/1990 | Wright | 601/152 |
| 4,938,208 | A | | 7/1990 | Dye | |
| 4,945,905 | A | | 8/1990 | Dye et al. | |
| 4,966,396 | A | | 10/1990 | Dye | |
| 4,971,044 | A | | 11/1990 | Dye | |
| 5,007,411 | A | | 4/1991 | Dye | |
| 5,022,387 | A | | 6/1991 | Hasty | |
| 5,031,604 | A | | 7/1991 | Dye | |
| 5,117,812 | A | | 6/1992 | McWhorter | |
| 5,121,746 | A | * | 6/1992 | Sikora | 128/203.12 |
| D327,738 | S | | 7/1992 | Dye | D24/129 |
| D328,346 | S | | 7/1992 | Dye | D24/129 |
| D330,250 | S | | 10/1992 | Dye | D24/129 |
| D330,251 | S | | 10/1992 | Dye | D24/129 |
| 5,186,163 | A | | 2/1993 | Dye | |

* cited by examiner

*Primary Examiner*—Danton D. DeMille
*Assistant Examiner*—Benjamine Koo

(57) ABSTRACT

A pair of compression sleeves and a manifold tubing set is provided as an integral unit. The tubing set comprises a first set of conduits integrally connected to the first sleeve and a second set of conduits integrally connected to the second sleeve. The first and second conduit sets are connected at a controller connection device comprising a manifold, having a plurality of fluidly isolated, branched fluid passages, and a connector for plugging directly into a controller for a source of compressed air. The only connection that must be made prior to operation of the device is the connection at the controller.

11 Claims, 4 Drawing Sheets

INTEGRAL COMPRESSION SLEEVES AND MANIFOLD TUBING SET

This application is a continuation of Application No. 08/497,002, filed Jun. 30, 1995 now abandoned, which is a continuation of application Ser. No. 08/218,409, filed Mar. 28, 1994 now abandoned.

FIELD OF THE INVENTION

This invention relates to intermittent pneumatic compression devices and more particularly to the interconnection between compression sleeves and controllers for a source of compressed air.

BACKGROUND OF THE INVENTION

Compression devices are used to improve circulation and prevent the formation of thrombi in the limbs of patients. These devices typically include a pair of compression garments or sleeves which wrap around the patient's limbs, generally legs. Each sleeve has a plurality of separate inflatable chambers which are connected via conduits to a source of compressed fluid, typically air. The chambers are sequentially inflated to provide a compressive pulse to the limb, thereby increasing blood circulation and minimizing the formation of thrombi. The compressive pulses begin around the portion of the limb farthest from the heart and progress sequentially toward the heart. For example, for a three-chambered leg sleeve, the ankle chamber is inflated first, followed by the calf chamber, and then the thigh chamber. Typical compression devices are described in U.S. Pat. Nos. 4,013,069 and 4,030,488, incorporated herein by reference.

The compression sleeves are in fluid communication with the compressed air source via a plurality of conduits. A separate conduit may be provided between the compressed air source and each chamber of the sleeve, so that the inflation of each chamber may be separately controlled. An additional conduit is also generally provided for cooling. Thus, for a three-chambered sleeve, four conduits may interconnect each sleeve and the compressed air source.

In prior art devices, a pair of sleeves, i.e., one for each leg, are used for each patient. The sleeves are separately provided, and a set of conduits is integrally formed with each of the sleeves and terminates with a connection device. A tubing set having a Y or T configuration comprising three additional sets of conduits is provided to interconnect the sleeves to the controller. More particularly, the tubing set comprises a connection device which plugs into the controller and a first set of conduits extending from the connection device. The first set of conduits terminates at a divider downstream of the controller connection. At the divider, the conduits from the first set are fluidly divided into two additional conduits defined by a second and a third set of conduits. The second and third sets of conduits each terminate with a connection device which mates with the terminating connection device on each of the sets of conduits integrally formed with the sleeves. Accordingly, the nurse or other medical personnel operating the device must make three separate connections to establish fluid communication between each sleeve and the controller. In operation, the sleeves are generally disposable, whereas the tubing set and controller are reusable. Conduit sets of this type are described in U.S. Pat. No. 4,253,449, incorporated herein by reference.

SUMMARY OF THE INVENTION

The present invention provides integral compression sleeves and a manifold tubing set. A set of individual conduits is integrally formed with each of a pair of compression sleeves. In one embodiment, the conduits of each set are permanently affixed to a controller connection device which plugs directly into a controller for providing compressed fluid to the sleeves. The connection device is formed as a unitary piece comprising a manifold and a connector member configured to connect directly to a plurality of fluid ports on the controller. A plurality of separate, divided passages within the device provide fluid communication between corresponding ports on the controller and individual ones of the conduits of each set. In this manner; a single fluid connection is provided between the sleeves and the controller. The controller may be placed close to the patient's bed; for example, it may be mounted directly to the foot of the bed frame. The sleeves and integral tubing set together may comprise a disposable unit. An extension tubing set between the connection device of the present invention and the controller may also be utilized to place the controller farther from the bed.

In a further embodiment of the present invention, the integral compression sleeves and manifold tubing set comprises a first set of individual conduits integrally connected to a first sleeve and a second set of individual conduits integrally connected to a second sleeve. The first and second sets are fixedly attached to a manifold. A third set of individual conduits is fixedly attached to the manifold and is further fixedly attached to a connector which plugs directly into the controller to integrally interconnect the manifold and the connector. The tubing set of this embodiment still provides only a single connection, yet allows the controller to be placed farther from the patient's bedside.

DESCRIPTION OF THE DRAWINGS

The invention will be more fully understood from the following detailed description taken in conjunction with the accompanying drawings in which.

DETAILED DESCRIPTION OF THE INVENTION

Figure 1:
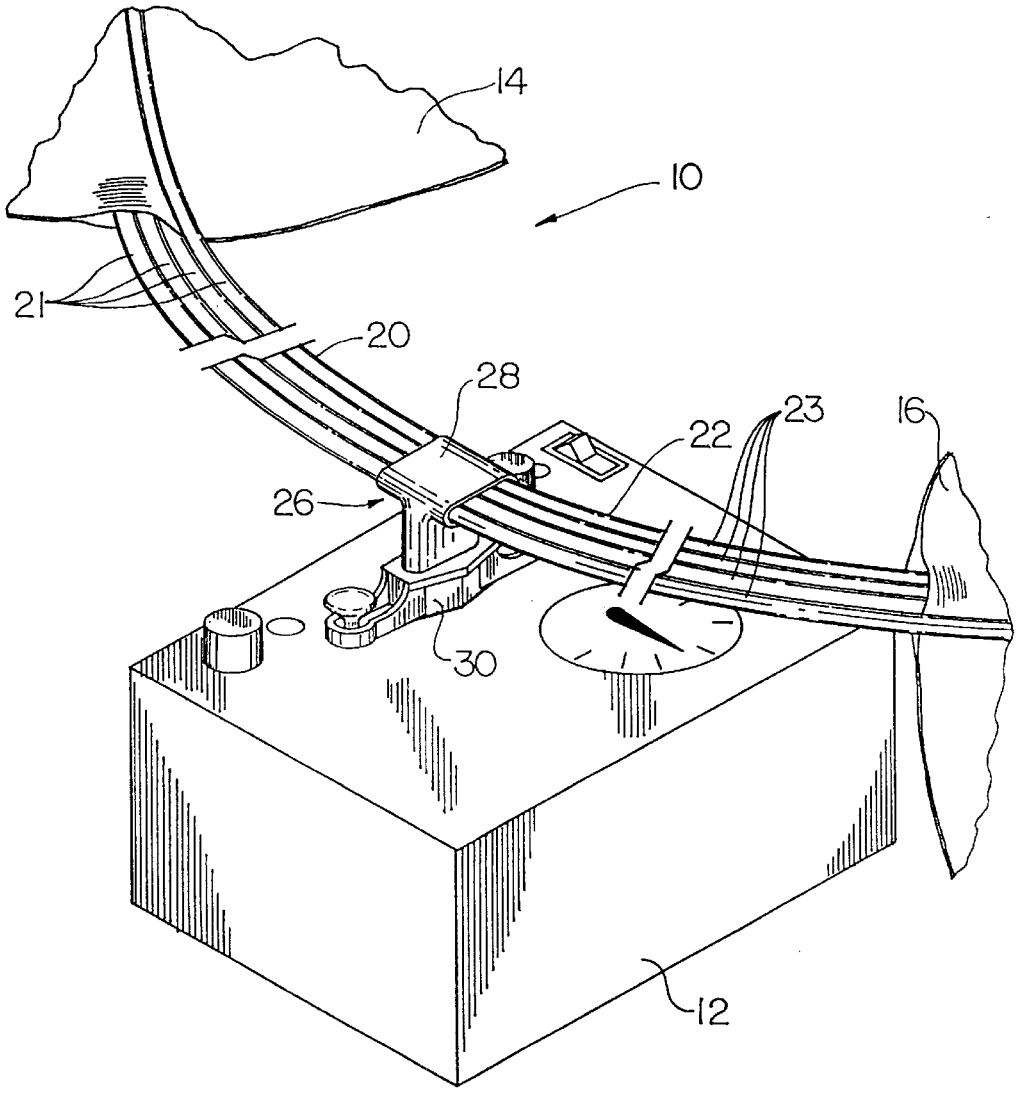
FIG. 1 is a perspective view of the integral compression sleeves and manifold tubing set of the present invention.

The integral compression sleeves and manifold tubing set 10 of the present invention is shown generally in FIG. 1. A controller 12 which controls a source of compressed air is provided to supply pulses of compressed air to a pair of compression sleeves 14, 16 for a patient's limbs. The controller may be of any suitable type, such as that described in U.S. Pat. Nos. 4,013,069 and 4,030,488, incorporated herein by reference. Each sleeve of the pair of compression sleeves has a plurality of chambers. The compression sleeves may be of any suitable type, such as that shown in U.S. Pat. Nos. 4,198,961, 4,202,325, 4,207,875, 4,207,876, and 4,402,312, incorporated herein by reference.

The manifold tubing set, comprises a first set 20 of individual conduits 21 integrally formed with the first compression sleeve 14. Each of the chambers in the sleeve is in communication with one of the conduits 21. As heretofore mentioned, an additional conduit is provided to supply cooling air to ventilation channels in the sleeve. A second set 22 of individual conduits 23 is in like manner integrally formed with the second compression sleeve 16. Since the preferred compression sleeves have three compression chambers, as shown in the drawings, each set of conduits will preferably comprise four individual conduits, one communicating with each of the chambers and a fourth conduit in communication with ventilation channels in the sleeve for circulating cooling air. For ease of handling, the conduits of a set are typically extruded together along their length.

Figure 2:
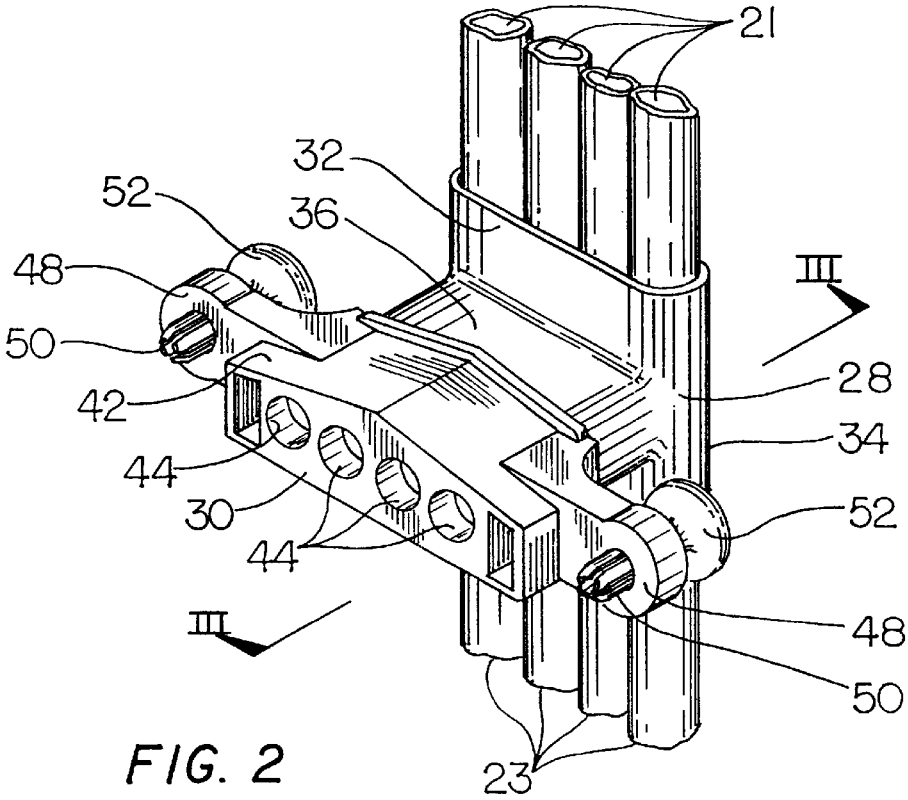
FIG. 2 is a perspective view of the connection device of the present invention.

Each set of conduits 20, 22 is directly connected to a controller connection device 26. The controller connection device plugs directly into the controller 12. In the preferred embodiment illustrated in FIGS. 1 through 3, the controller connection device 26 comprises a manifold 28 having a T configuration and a connector member 30 for direct connection to the controller 12. The controller connection device may be made from any suitable material, such as a high impact ABS plastic. Preferably, the manifold 28 and connector member 30 are integrally formed, such as by a suitable molding process, to provide a unitary piece.

The T-shaped manifold comprises a first housing section 32 and a second housing section 34 generally aligned with the first housing section. A third housing section 36 is provided which is shown for purposes of illustration as being generally perpendicular to the first and second housing sections. The third housing section 36 of the T-shaped manifold 28 is integrally formed with the connector member 30 which connects directly to the controller 12. The connector member comprises a connector housing 42 having an outer configuration chosen to fit within a corresponding opening in the controller 12. A pentagonal outer configuration is shown, but any suitable configuration may be provided.

Figure 3:
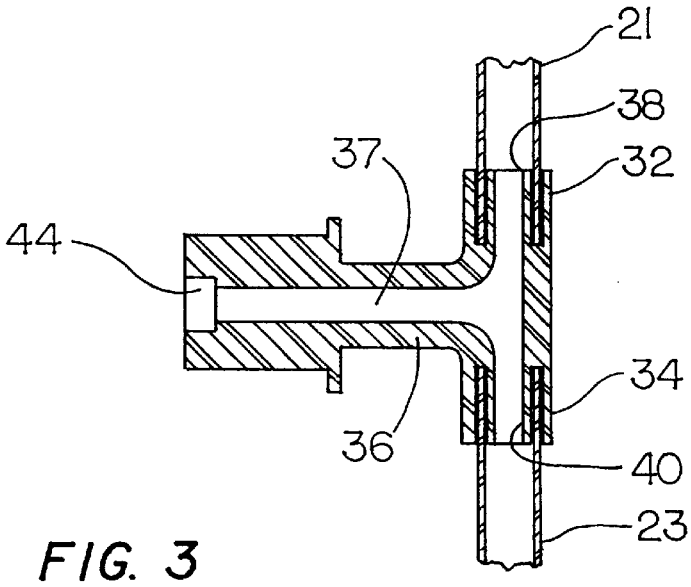
FIG. 3 is a cross-sectional view along line III—III of FIG. 2.

A plurality of fluidly isolated, divided fluid passages 37 are disposed within the T-shaped manifold 28 and the connector member 30 for fluid communication with corresponding ones of the multiple conduits 21 and 23, as described further below. A single fluid passage is shown in FIG. 3.

A plurality of first ports 38, each corresponding to one of the conduits 21 of the first set 20, are disposed within the first section 32 of the manifold to surround a portion of each passage 37. Similarly, a plurality of second ports 40, each corresponding to one of the conduits 23 of the second set 22, are disposed within the second section 34 to surround a further portion of each passage 37.

Each port 38, 40 has a circular cross-sectional shape and is sized to receive an end of an associated conduit from one of the pair of sleeves. The conduits are fixedly attached to each port by any suitable method, such as solvent bonding, so that the conduits cannot be pulled off the ports. The first and second housing sections are sized to snugly surround the conduits when the conduits are attached to the ports to provide additional protection to the conduits and ports.

A plurality of widened fluid connection ports 44 are formed within the connector housing 42. The widened ports communicate with a corresponding number of fluid ports at the controller 12 when the connector member is connected to the controller. Each widened port in the connector housing further communicates with corresponding ones of the fluid passages 37.

The connector member 30 comprises a pair of side extensions 48 on which are mounted releasable fastening members 50 to attach the connector member to the controller. Each fastening member may be formed as an expandable member comprising a split anchor provided on each extension. Each expandable member is inserted into a corresponding opening on the controller housing. Depression of a plunger 52 causes the split anchor to expand and lock into frictional engagement with the opening on the controller housing. To unlock the device, the plunger is withdrawn, allowing the split anchor to retract and be withdrawn from the opening. Any other suitable releasable fastening member may be provided.

In operation, to provide fluid to the chambers of the sleeves, fluid flowing from the controller first enters the widened ports 44 of the connector member 30. From the widened ports, the fluid enters the fluid passages 37. In the passages 37, the fluid flow divides into two streams within the manifold and travels through the first and second ports 38, 40 into the multiple conduits 21, 23. In this manner, fluid from the controller is separately distributed to the first conduit set 20 and the second conduit set 22, and thence to the sleeves.

The integral sleeves and tubing set 10 of the present invention allows the controller to be placed close to the patient, such as at the end of the patient's bed. If desired, the controller 12 may be mounted or secured on or in close proximity to the bed. In this manner, the controller is located close to the patient's legs. The length of the conduits 21, 23 from each sleeve 14, 16 to the controller connection device 26 is preselected to ensure that the connection device is outside of the bed while at the same time minimizing the amount of tubing inside the bed which may become dirty or contaminated or entangled with the patient. When the controller is located at the foot of the bed, no additional length of tubing is needed between the manifold and the controller. Also, by locating the connection device 26 outside the bed, the patient does not lay on-the connection device, which may be uncomfortable or cause injury. Prior art sleeves typically include short lengths of tubing, which makes storage and disposal of the sleeves relatively simple. However, the short tubing lengths often resulted in placing at least two connection devices within the patient's bed, where the patient could lay on or roll over them. Also, the short tubing lengths resulted in a portion of the reusable tubing lying in the bed where it could become dirty or contaminated, rendering it unfit for reuse prior to the expiration of its expected useful lifespan.

Figure 4:
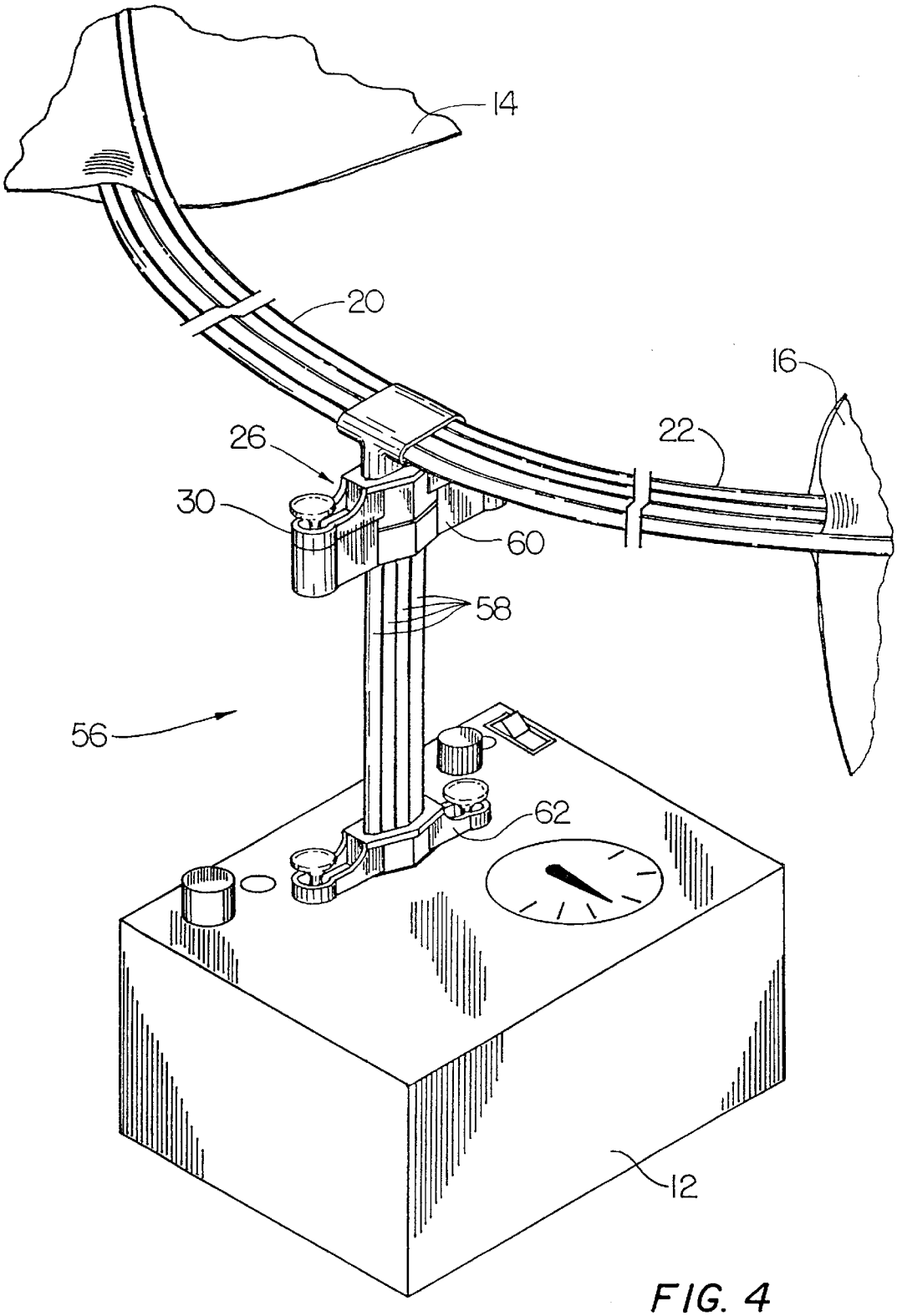
FIG. 4 is a perspective view of a further embodiment of the present invention.

If it is necessary to locate the controller at a location farther from the patient, an extension tubing set 56 may be used, as shown in FIG. 4. Such an extension tubing set comprises a suitable length of tubing comprising multiple conduits 58 having a connection 60 at one end adapted to connect to the connector member 30 of the controller connection device 26. A connection 62 is provided at the other end of the length of tubing to connect directly to the controller 12. Unlike prior art Y-shaped tubing sets, which are bulky and difficult to store, the extension tubing set 56 may be easily rolled or coiled or wrapped around the controller for storage if desired.

Figure 5:
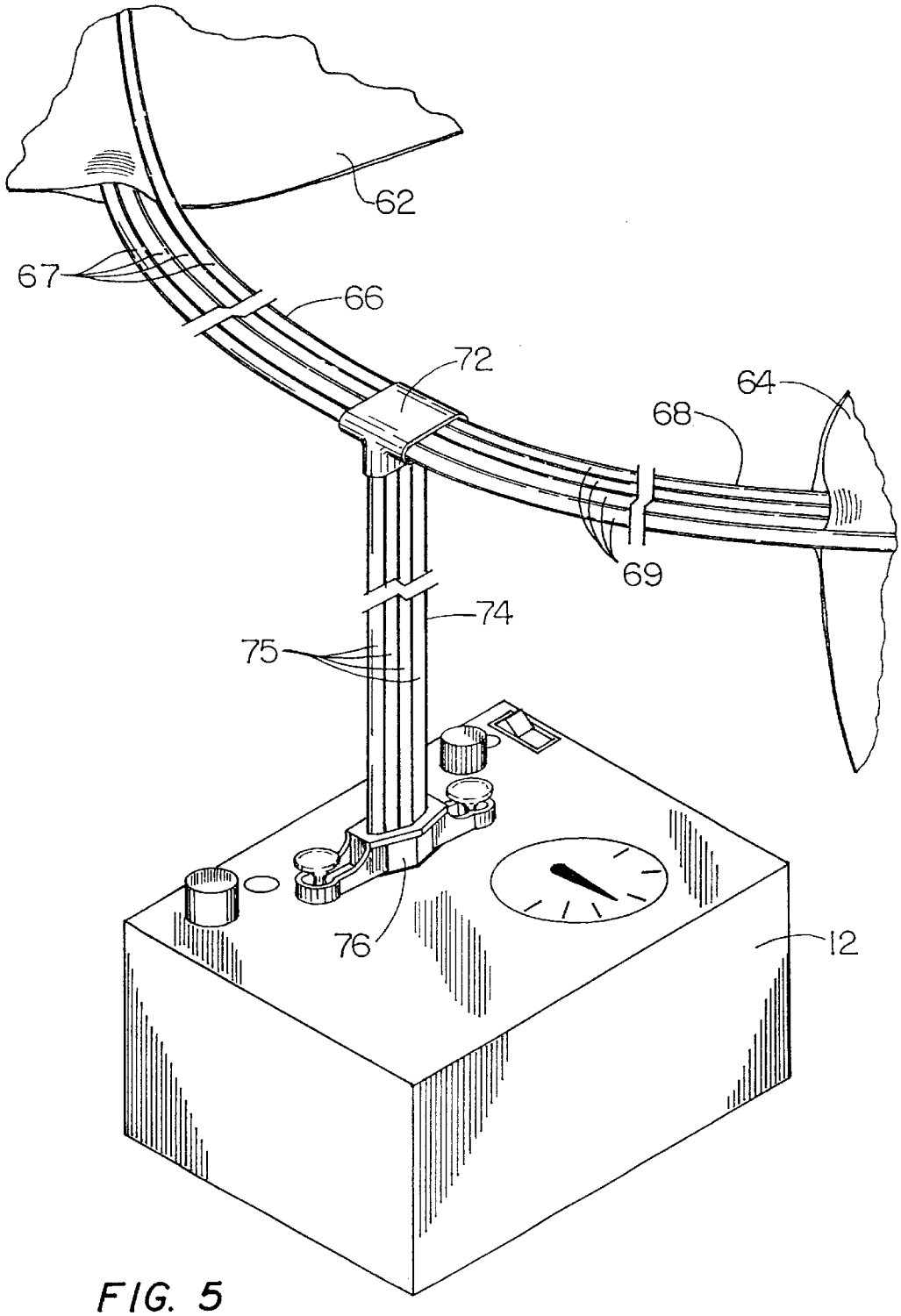
FIG. 5 is a perspective view of a still further embodiment of the present invention.

A further embodiment of the present invention is shown in FIG. 5. The integral sleeves and tubing set comprises a pair of sleeves 62, 64. A first set 66 of individual conduits 67 is integrally connected to the first sleeve 62, and a second set 68 of individual conduits 69 is integrally connected to the second sleeve 64. The first and second sets are fixedly attached to a manifold 72, as described above in connection with FIGS. 1 through 3. A third set 74 of individual conduits 75 is also fixedly attached to the manifold 72 and is further fixedly attached to a connector 76, which plugs directly into the controller 12. The conduits 75 may be fixed to the manifold 72 and connector 76 in any suitable manner, such as by solvent bonding, to ensure that the conduits cannot be pulled off. In this manner, the third tubing set integrally interconnects the manifold and the connector 76. The tubing set of this embodiment still provides only a single connection, yet allows the controller to be placed farther from the patient's bedside.

The invention is not to be limited by what has been particularly shown and described except as indicated by the appended claims.

I claim:

1. A device for use with a compression device having a controller for a source of compressed fluid, the controller including a housing and a plurality of fluid ports located adjacent a wall of the housing, comprising:

a first compression sleeve and a second compression sleeve, each of said compression sleeves comprising at least one inflatable chamber;

a tubing set integrally formed with said first and second compression sleeves, said tubing set comprising:

a first set of uninterrupted conduits integrally connected at a first end to said first compression sleeve to supply fluid to each said inflatable chamber of said first compression sleeve, said uninterrupted conduits comprising continuous lengths of tubing unbroken from said first end to a second end;

a second set of uninterrupted conduits integrally connected at a first end to said second compression sleeve to supply fluid to each said inflatable chamber of said second compression sleeve, said uninterrupted conduits comprising continuous lengths of tubing unbroken from said first end to a second end;

a controller connection device for connection to the controller, said controller connection device comprising a manifold and a connector member integrally formed with said manifold as a unitary piece, the connector member further including a releasable fastening assembly configured to mate with the controller to directly connect the controller connection device to the plurality of fluid ports located adjacent the wall of the controller housing, said first set of uninterrupted conduits and said second set of uninterrupted conduits being fixedly joined at respective ones of the second ends to said manifold of said controller connection device, said connection device further having a plurality of fluidly isolated, branched fluid passages therein for fluid communication between respective ones of said ports of said controller and respective conduits of said first set of conduits and respective conduits of said second set of conduits.

2. The device of claim 1 wherein said manifold of said controller connection device comprises a first housing section and a second housing section generally aligned with said first housing section, a plurality of first ports in said first housing section and a plurality of second ports in said second housing section in fluid communication with said plurality of first ports, said first set of conduits being fixedly attached to corresponding ones of said plurality of first ports, and said second set of conduits being fixedly attached to corresponding ones of said plurality of second ports.

3. The device of claim 1, wherein said connector member of said controller comprises a connector housing, a plurality of fluid passages disposed within said connector housing for connection to a corresponding plurality of fluid ports at the controller, said plurality of fluid passages being in fluid communication with respective ones of said plurality of first ports and said plurality of second ports in said manifold.

4. The device of claim 1 wherein said manifold of said controller connection device comprises a junction between said first set of conduits and said second.set of conduits.

5. The device of claim 1 wherein each of said fluidly isolated, branched fluid passages comprises a first branch in fluid communication with corresponding ones of said first set of conduits, a second branch in fluid communication with corresponding ones of said second set of conduits, and a third branch in fluid communication with corresponding ones of the plurality of fluid ports on the controller.

6. The device of claim 1 wherein each of said branched fluid passages comprises a generally T-shaped configuration.

7. The device of claim 1 wherein said unitary piece is formed by molding.

8. The device of claim 1 wherein the lengths of said first set of conduits and said second set of conduits are, preselected to extend outside of a bed of a patient when said first and second compression sleeves are in operation on the legs of the patient.

9. The device of claim 1 wherein said first set of conduits and said second set of conduits are fixedly joined to said manifold by solvent bonding.

10. The device of claim 1 wherein said releasable fastening assembly on said controller connection device comprises a pair of expandable and retractable members sized for frictional engagement upon expansion within corresponding openings in the controller.

11. The device of claim 1 wherein each said set of conduits includes a conduit for supplying cooling air to each of said sleeves.

* * * * *